US005087212A

United States Patent [19]

Hanami

[11] Patent Number: 5,087,212

[45] Date of Patent: Feb. 11, 1992

[54] SOCKET FOR LIGHT EMITTING DIODE

[75] Inventor: Chiyoki Hanami, Tokyo, Japan

[73] Assignee: Hirose Electric Co., Ltd., Tokyo, Japan

[21] Appl. No.: 598,370

[22] Filed: Oct. 16, 1990

[30] Foreign Application Priority Data

Oct. 16, 1989 [JP] Japan ..... 1-119693[U]

[51] Int. Cl.[5] ..... H01R 13/66

[52] U.S. Cl. ..... 439/620; 362/800

[58] Field of Search ..... 439/620, 546, 547; 362/226, 800

[56] References Cited

U.S. PATENT DOCUMENTS

| | | | |
|---|---|---|---|
| 2,953,769 | 9/1960 | Woofter et al. | 439/546 X |
| 4,471,414 | 9/1984 | Savage | 362/800 X |
| 4,580,859 | 4/1986 | Frano et al. | 339/91 R |
| 4,667,270 | 5/1987 | Yagi | 361/380 |
| 4,727,648 | 3/1988 | Savage, Jr. | 29/839 |
| 4,837,927 | 6/1989 | Savage, Jr. | 29/839 |

*Primary Examiner*—Eugene F. Desmond
*Attorney, Agent, or Firm*—Kanesaka & Takeuchi

[57] ABSTRACT

A socket for a light emitting diode with a pair of leads, which includes a case (2); a first lead terminal (4) provided in the case and having a resistor contact and a first lead contact for contact with one of the leads; a second lead terminal (5) provided in the case and having a first contact portion and a second lead contact for contact with the other lead; a contact terminal (6) provided within the case and having a second contact portion and a second resistor contact; a resistor (7) provided within the case so that the resistor is held between the first and second resistor contacts.

1 Claim, 11 Drawing Sheets

SOCKET FOR LIGHT EMITTING DIODE

BACKGROUND OF THE INVENTION

1. Field of the Invention

The present invention relates to sockets for light emitting diodes which are used as indicator lamps of automatic transmission or the like.

2. Description of the Prior Art

Conventionally, the indicators of automatic transmissions have consisted of a light emitting diode (LED) and a current limiting resistor which are soldered on a flexible printed circuit board having a thickness of about 100 microns instead of a rigid printed circuit board having a thickness of about 1.6 mm because they are mounted on a vehicle, especially on its instrument panel or torque converter indicator.

However, in the above indicators, it has been necessary to solder the LED and the current limiting diode, requiring a large amount of labor for the indicator manufacture.

SUMMARY OF THE INVENTION

Accordingly, it is an object of the invention to provide a socket which is able to eliminate the soldering operation of an LED and a current limiting diode, thereby making the indicator manufacture easier.

According to the invention there is provided a socket for a light emitting diode with a pair of leads, which includes a case; a first lead terminal provided in the case and having a resistor contact and a first lead contact for contact with one of the leads; a second lead terminal provided in the case and having a first contact portion and a second lead contact for contact with the other lead; and a contact terminal provided within the case and having a second contact portion and a second resistor contact such that the resistor is held between the first and second resistor contacts.

By incorporating a light emitting diode within the case, it is possible to eliminate the soldering operation of the LED and the current limiting resistor.

The above and other objects, features, and advantages of the invention will be more apparent from the following description when taken in connection with the accompanying drawings.

DESCRIPTION OF THE PREFERRED EMBODIMENT

Figure 1:
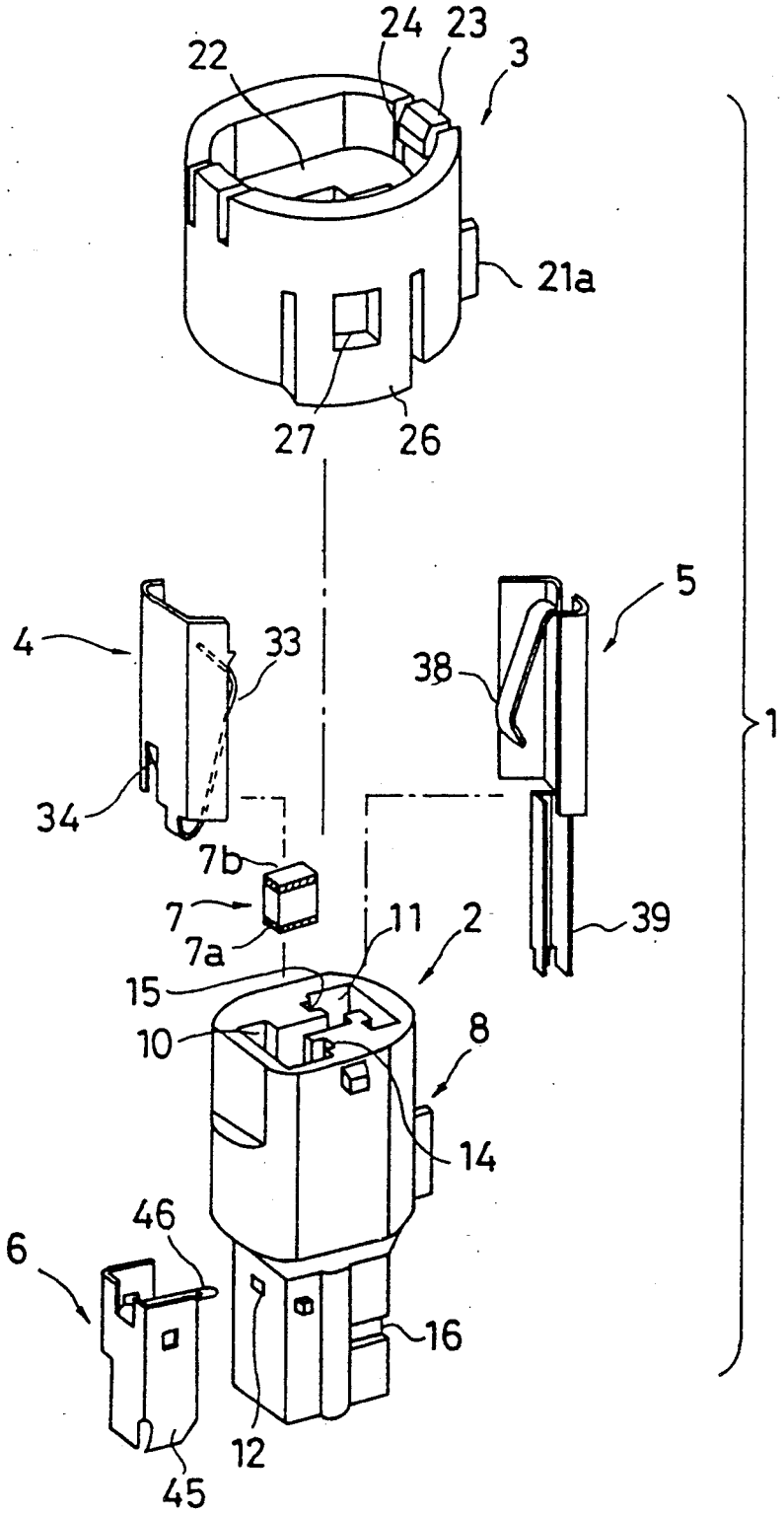
FIG. 1 is an exploded, perspective view of a socket according to an embodiment of the invention.
Figure 4:
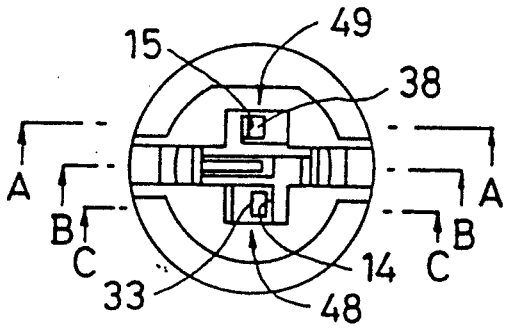
FIG. 4 is a top plan view of the socket.
Figure 2:
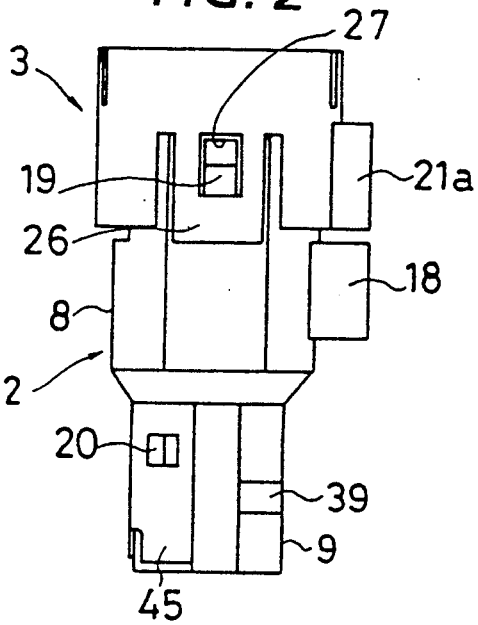
FIG. 2 is an elevational front view of the socket.
Figure 3:
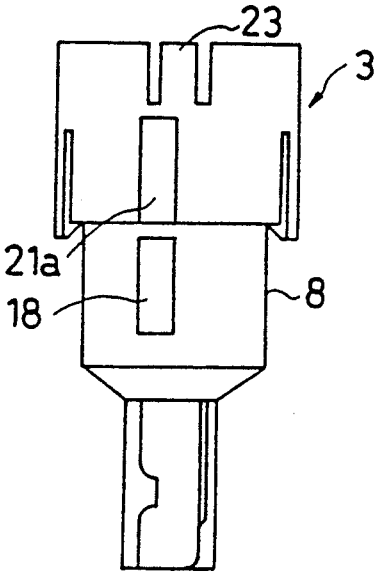
FIG. 3 is a right-hand side view of the socket.
Figure 5:
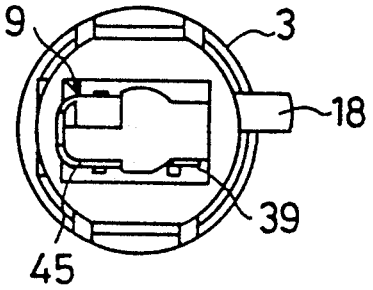
FIG. 5 is a bottom plan view of the socket.
Figure 6:
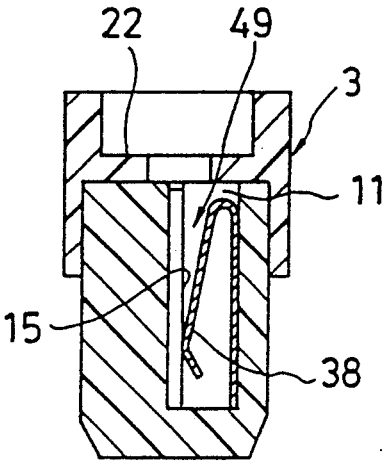
FIG. 6 is a sectional view taken along the line A—A of FIG. 4.
Figure 7:
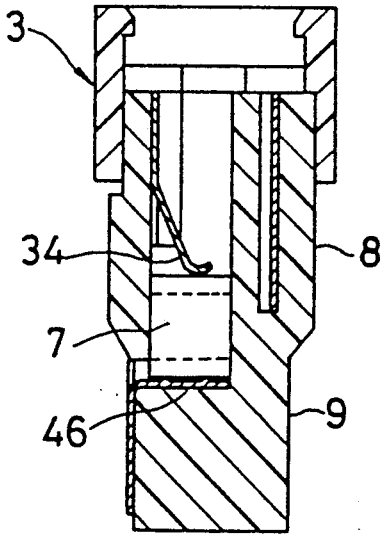
FIG. 7 is a sectional view taken along the line B—B of FIG. 4.
Figure 8:
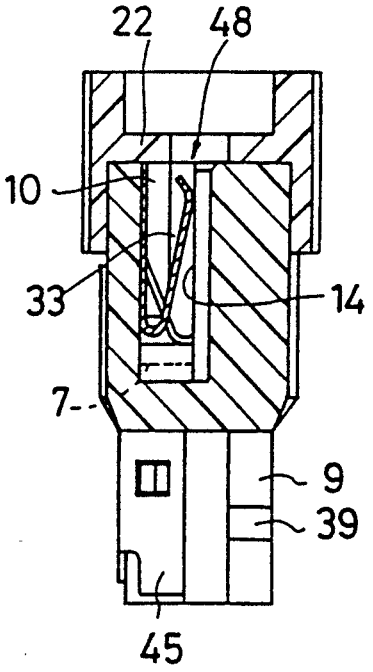
FIG. 8 is a sectional view taken along the line C—C of FIG. 4.
Figure 12:
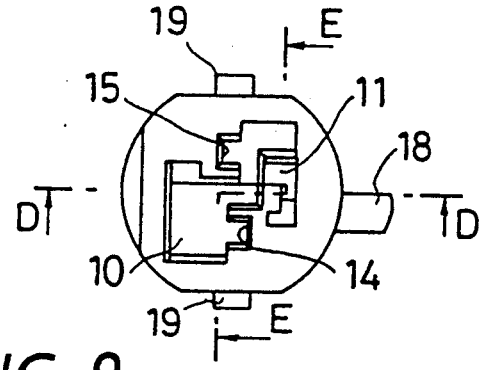
FIG. 12 is a top plan view of the socket body.
Figure 9:
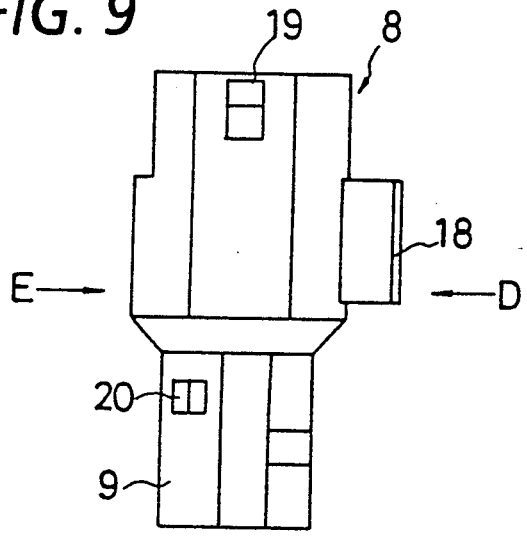
FIG. 9 is a front elevational view of a socket body according to an embodiment of the invention.
Figure 10:
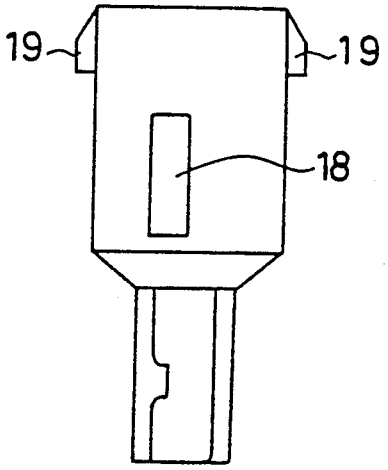
FIG. 10 is a right-hand side view of the socket body.
Figure 11:
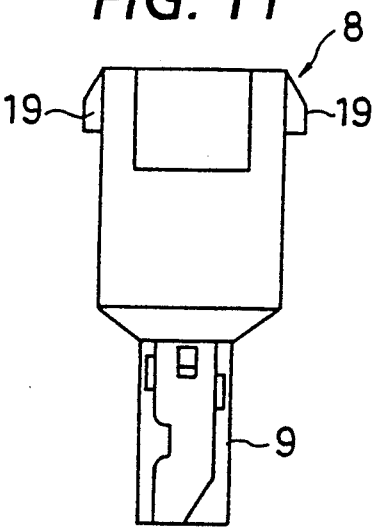
FIG. 11 is a left-hand side view of the socket body.
Figure 13:
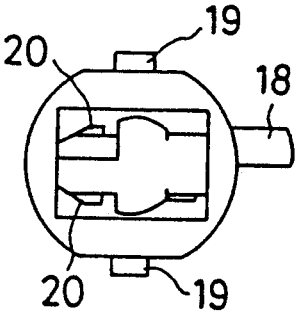
FIG. 13 is a bottom plan view of the socket body.
Figure 14:
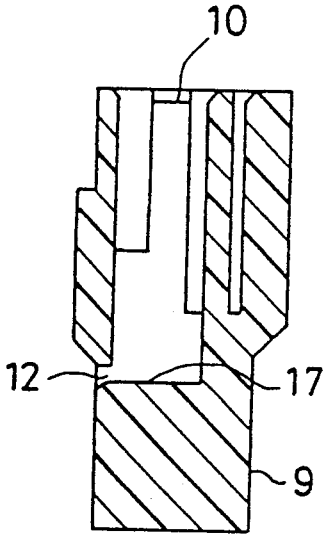
FIG. 14 is a sectional view taken along the line D—D of FIG. 12.
Figure 15:
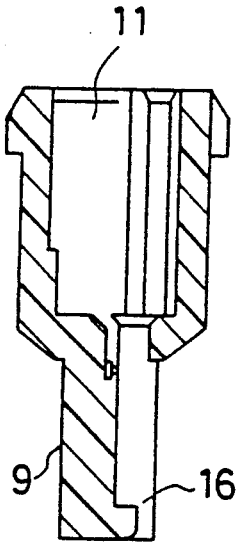
FIG. 15 is a sectional view taken along the line E—E of FIG. 12.
Figure 18:
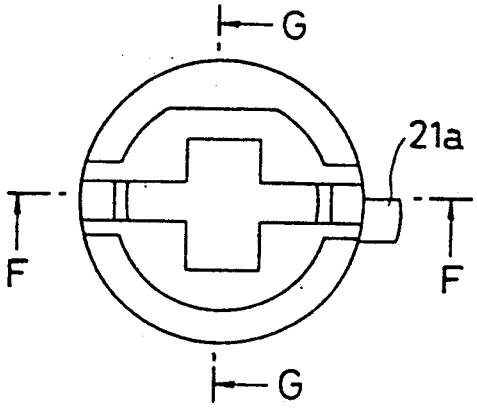
FIG. 18 is a top plan view of the cover.
Figure 20:
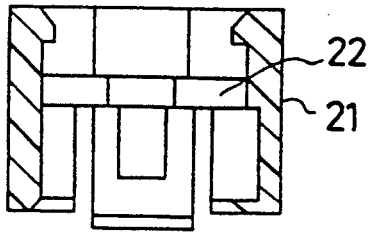
FIG. 20 is a sectional view taken along the line F—F of FIG. 18.
Figure 16:
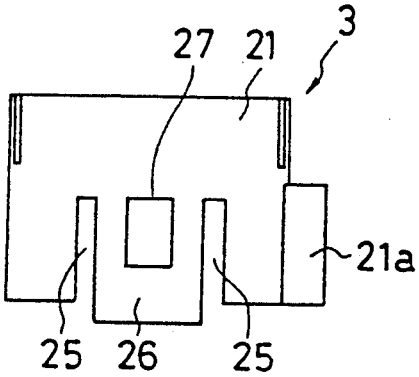
FIG. 16 is a front elevational view of a cover according to an embodiment of the invention.
Figure 17:
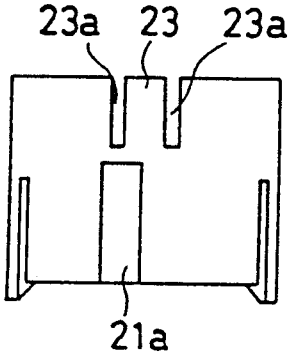
FIG. 17 is a right-hand side view of the cover.
Figure 19:
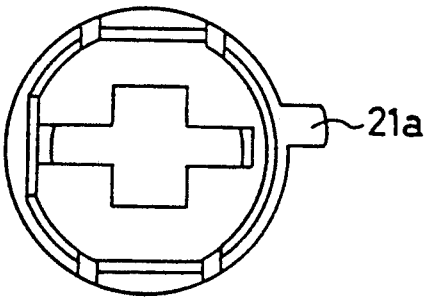
FIG. 19 is a bottom plan view of the cover.
Figure 21:
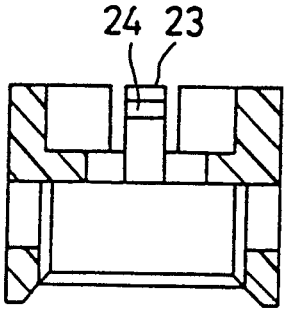
FIG. 21 is a sectional view taken along the line G—G of FIG. 18.
Figure 24:
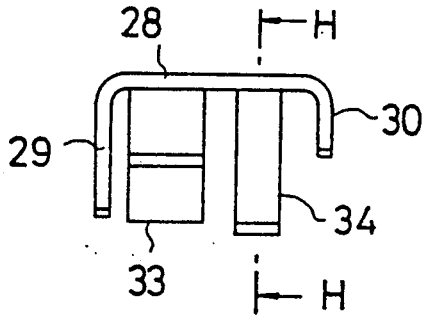
FIG. 24 is a left-hand side view of the lead terminal.
Figure 22:
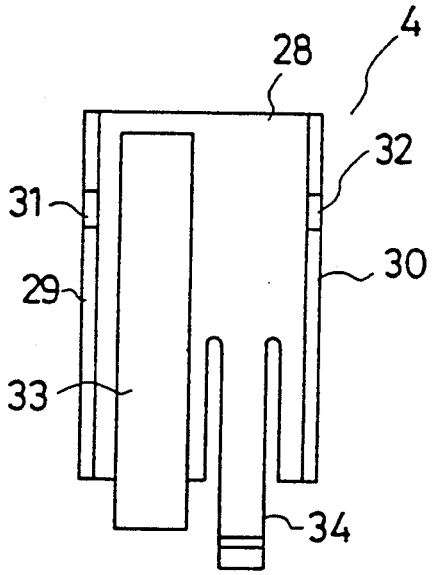
FIG. 22 is a front elevational view of a first lead terminal according to an embodiment of the invention.
Figure 23:
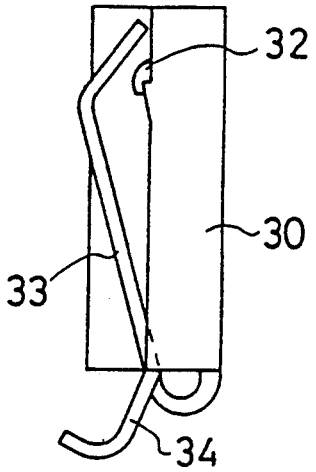
FIG. 23 is a right-hand side view of the lead terminal.
Figure 25:
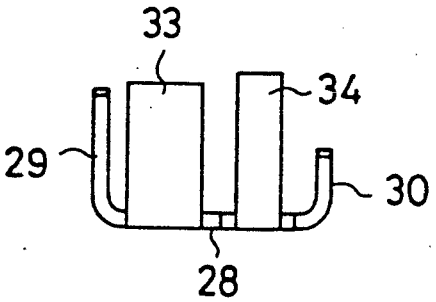
FIG. 25 is a bottom plan view of the lead terminal.
Figure 26:
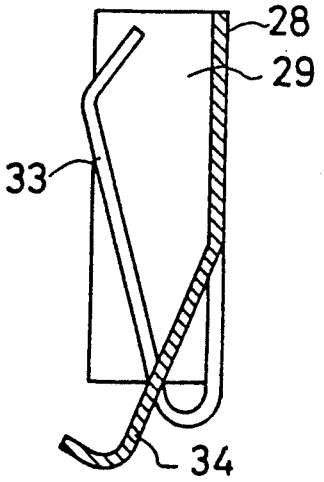
FIG. 26 is a sectional view taken along the line H—H.
Figure 30:
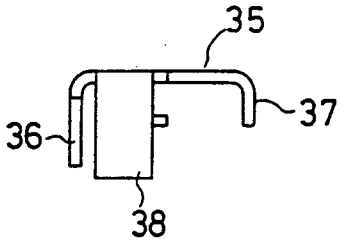
FIG. 30 is a bottom plan view of the lead terminal.
Figure 27:
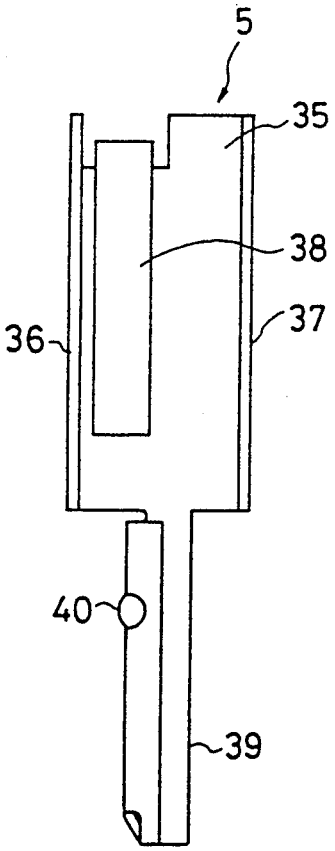
FIG. 27 is a front elevational view of a second lead terminal according to an embodiment of the invention.
Figure 28:
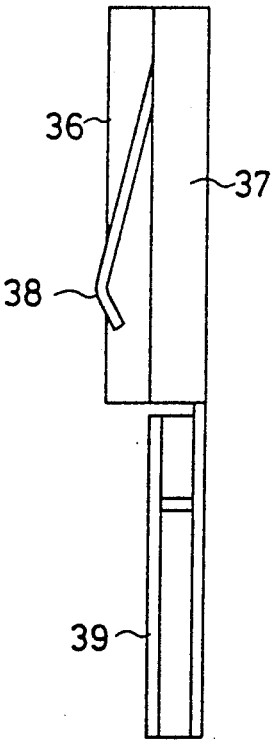
FIG. 28 is a right-hand side view of the lead terminal.
Figure 29:
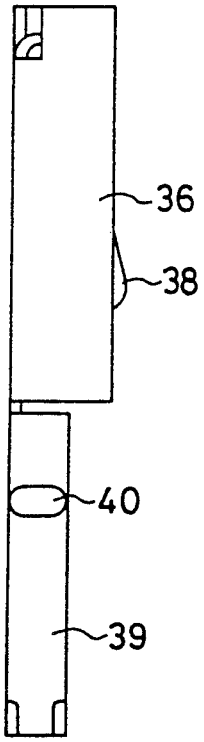
FIG. 29 is a left-hand side view of the lead terminal.
Figure 33:
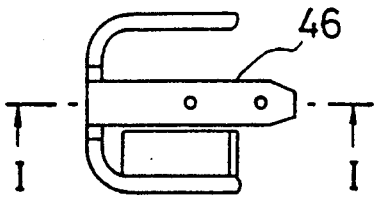
FIG. 33 is a top plan view of the contact terminal.
Figure 35:
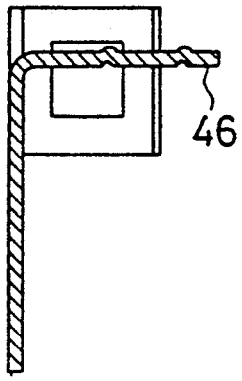
FIG. 35 is a sectional view taken along the line I—I of FIG. 33.
Figure 32:
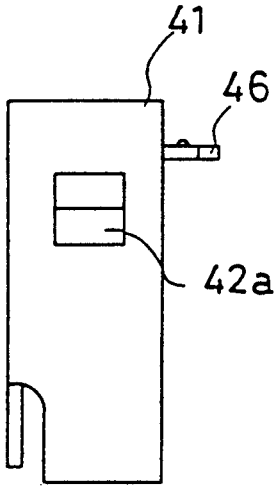
FIG. 32 is a left-hand side view of the contact terminal.
Figure 31:
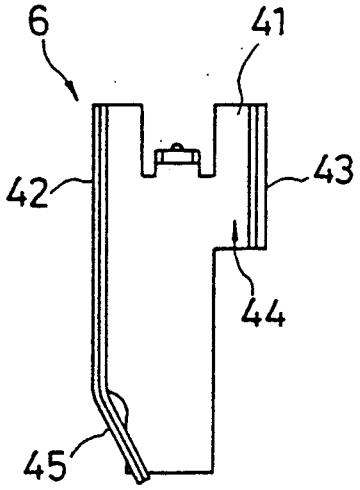
FIG. 31 is a front elevational view of a contact terminal according to an embodiment of the invention.
Figure 34:
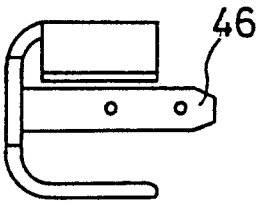
FIG. 34 is a bottom plan view of the contact terminal.

FIGS. 1-5 show a socket according to an embodiment of the invention. The socket 1 consists of a socket body 8; a cover 3 cooperating with the socket body 8 to form a case 2; a pair of lead terminals 4 and 5; a contact terminal 6; and a resistor 7.

As FIGS. 9-15 show, the socket body 8 has an lower insert portion 9 having a diameter less than that of an upper portion. The socket body 8 has three terminal apertures 10, 11, and 12. The terminal apertures 10 and 11 are formed in a diagonally opposed positions and have abutment face 14 and 15, respectively. The terminal aperture 11 extends downwardly to the interior of the insert portion 9, at the front face of which a terminal opening 16 is formed. The terminal aperture 12 opens at the left-hand side of the insert portion 9 and communicates with a bottom portion 17 of the terminal aperture 10. A positioning projection 18 is provided on the right-hand side of the socket body 8, and a pair of engagement projections 19 are provided on the front and rear faces of the socket body 8. A pair of engagement projections 20 are provided on the front and rear faces of the insert portion 9.

As FIGS. 16-21 show, the cover 3 has a cylindrical body 21 which has a terminal retainer 22 therein and two pairs of slits 23*a* extending downwardly from the top edge thereof to form a pair of retention arms 23 therebetween. Each retention arm 23 has a projection 24 extending inwardly from the top edge thereof. Two pairs of slits 25 extend upwardly from the bottom edge of the cover body 21 to form a pair of latch arms 26 each having an engagement hole 27. A positioning projection 21*a* extends laterally from the outside of the cover body 21 for positioning.

As FIGS. 22–26 show, the first lead terminal 4 has a terminal body 28 with opposite sides bent at substantially right angles to form a pair of flanges 29 and 30. The left-hand flange 29 is wider than the right-hand flange 30. A pair of engagement projections 31 and 32 are provided on the edges of the flanges 29 and 30. A lead contact 33 extends upwardly from the bottom edge of the terminal body 28 and bent at a free end portion in an L shape. A resistor contact 34 is cut out of the lower portion of the terminal body 28 such that it extends downwardly and has a free end curved.

As FIGS. 27–30 show, the second lead terminal 5 has a terminal body 35 with a pair of flanges 36 and 37 bent at substantially right angles, the left-hand flange 36 being wider than the right-hand flange 37. A lead contact 38 extends downwardly from the top edge of the terminal body 35 and is bent at a free end in the L shape. An elongated contact 39 extends downwardly from the bottom edge of the terminal body 35 and has a retention projection 40 at the upper portion for preventing it from falling off.

As FIGS. 31–35 show, the contact terminal 6 has a terminal body 41 with a pair of flanges 42 and 43 bent at substantially right angles to form a gripping portion 44. The flange 42 extends downwardly to form a contact portion 45. A resistor contact 46 extends laterally from the upper edge of the terminal body 41. An engagement hole 42*a* is formed above the contact portion 45.

The retainer portion 44 of the contact terminal 6 is fitted into the insert portion 9 of the socket body 8 so that the engagement projection 20 fits into the engagement hole 42*a* to attach the contact portion 45 to the insert portion 9 while the resistor contact 46 is fitted into the terminal aperture 12 to place the resistor contact 46 at the bottom of the terminal aperture 10. Then, the flat resistor 7 and the lead terminal 4 are placed into the terminal aperture 10 in this order so that the contact portions 7*a* and 7*b* of the resistor 7 are brought into contact with the resistor contact 46 of the contact terminal 6 and the resistor contact 34 of the lead terminal 4, respectively. The lead contact 33 of the lead terminal 4 is opposed to the abutment face 14 forming a lead aperture 48. Then, the lead terminal 5 is fitted into the terminal aperture 11 such that the contact element 39 is exposed via the terminal opening 16. The lead contact 38 of the lead terminal 5 is opposed to the abutment face 15 forming another LED lead insert portion 49. The cover 3 is then put on the socket body 8 so that the engagement projection 19 snaps into the engagement hole 27 of the latch arm 26 thereby attaching the cover 3 to the socket body 8 while securing the lead terminals 4 and 5 by pressing them down with the terminal retainer 22 of the cover 3.

Figure 36:
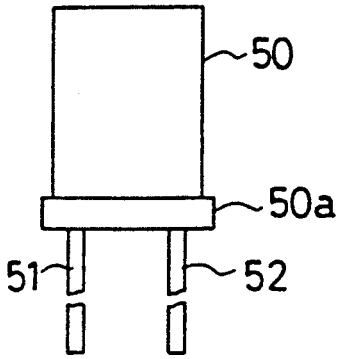
FIG. 36 is a front elevational view of a light emitting diode.

As FIG. 36 shows, the light emitting diode 50 has a pair of leads 51 and 52.

Figure 37:
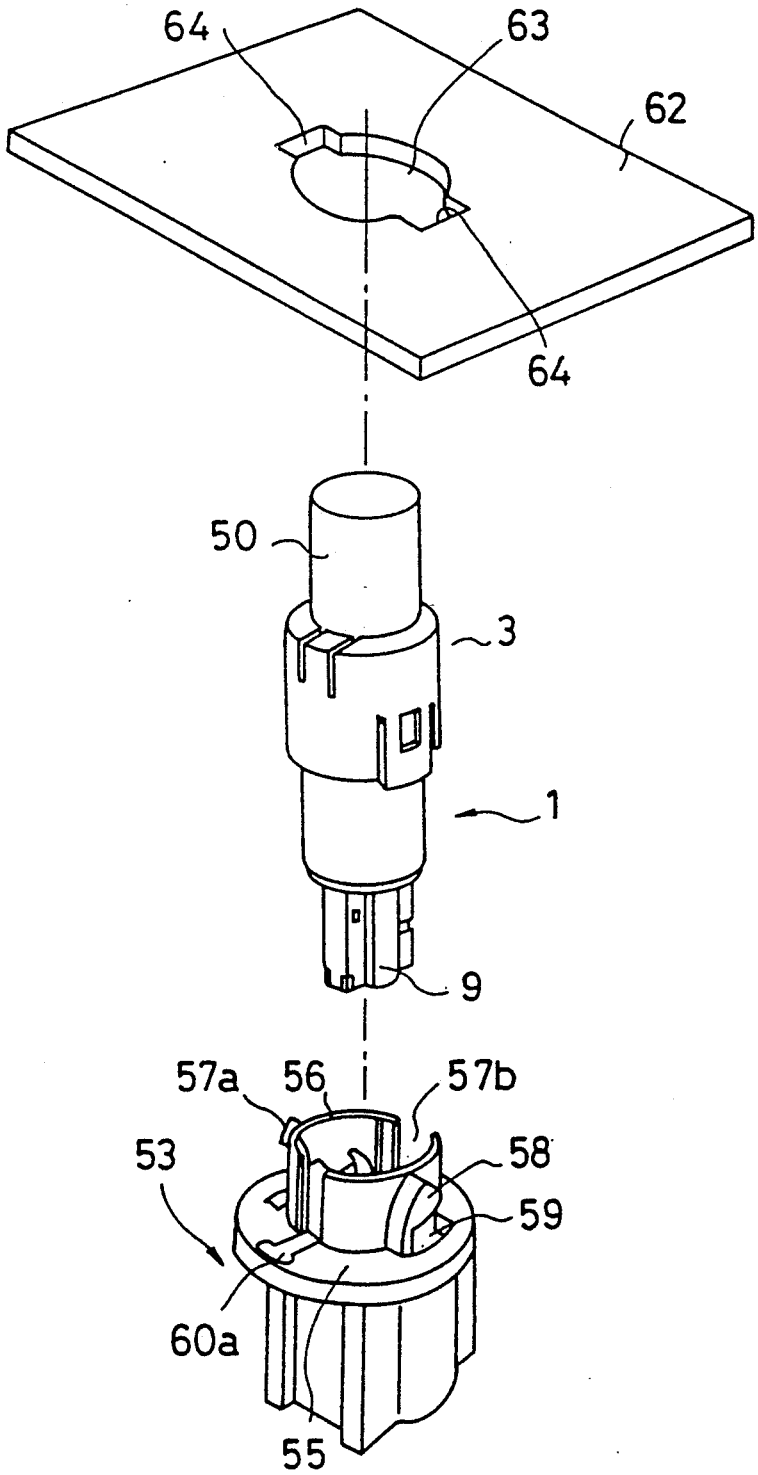
FIG. 37 is an exploded, perspective view of a PCB socket, and a PCB, a socket and an LED.
Figure 38:
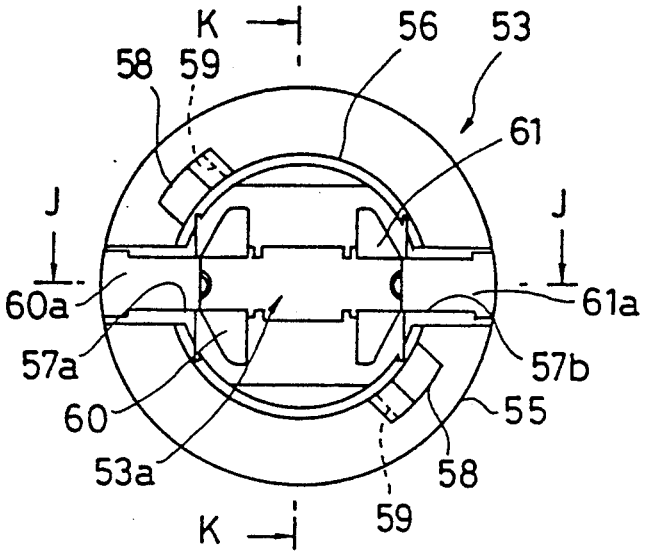
FIG. 38 is a top plan view of a PCB socket.
Figure 39:
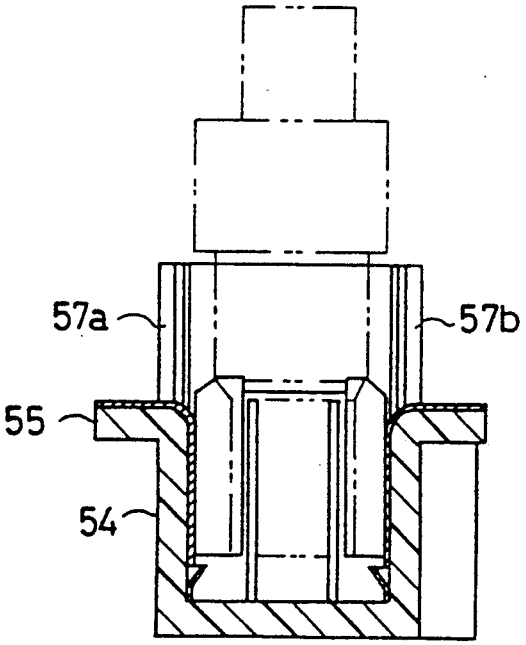
FIG. 39 is a sectional view taken along the line J—J of FIG. 38.
Figure 40:
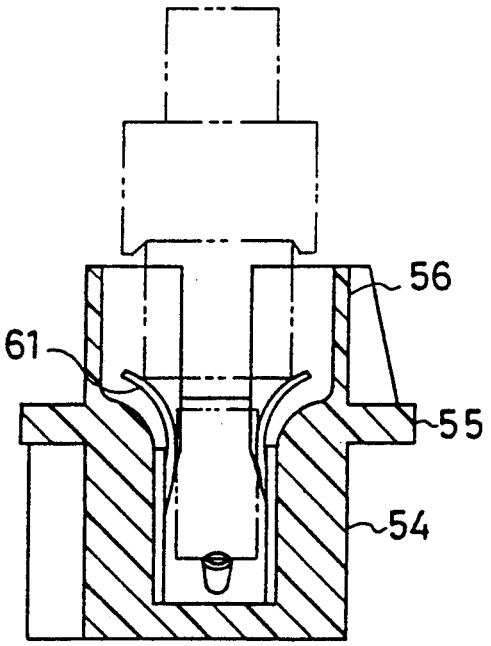
FIG. 40 is a sectional view taken along the line K—K.

FIGS. 37–39 show a PCB socket 53 to be mounted on a printed circuit board (PCB) 62. The PCB socket 53 has a socket body 54 which has an insert recess 53*a*, an abutment flange 55, and a cylindrical mouth 56 which has a pair of positioning slits 57*a* and 57*b*. A pair of latch arms 58 are engagement shoulder 59. A pair of contact elements 60 and 61 are provided within the insert recess 53*a* of the socket body 54 and each have a contact portion 60*a* or 61*a* at a free end. The contact portions 60*a* and 61*a* extend radially on the PCB abutment flange 55 beyond the positioning slots 57*a* and 57*b*, respectively.

The PCB 62 has a socket mounting hole 63 which has a pair of notches 64.

How to mount the LED 50 on the socket 1, the socket on the PCB socket 53, and the PCB socket on the PCB 62 will be described below.

The leads 51 and 52 of the LED 50 are inserted into the lead apertures 48 and 49 of the socket 1 so that the lead 51 is held between the lead contacts 33 of the lead terminals 4 and the abutment face 14 while the lead 52 is held between the lead contact 38 of the lead terminal 5 and the abutment face 15 so that the lead 51 is pressed against the lead contacts 33 and 38, respectively. The flange 50*a* of the LED 50 is held by the retention arms 23 of the cover 3.

Then, the insert portion 9 of the socket 1 is inserted into the insert recess 53*a* of the PCB socket 53 so that the contact portion 39 of the lead terminal 5 and the contact portion 45 of the contact terminal 6 are brought into contact with the contact elements 60 and 61 of the PCB socket 53.

Then, the mounting mouth 56 of the PCB socket 53 is inserted into the mounting hole 63 of the PCB 62 so that the PCB abutment portion 55 abuts on the mounting face of the PCB 62, and the PCB socket 53 is rotated so that the edge of the socket mounting hole 63 engages the engagement shoulders 59 of the latch arms 58. Consequently, the contact portion 60*a* and 61*a* of the PCB abutment portion 55 are brought into contact with the respective mounting surfaces. The positioning projection 18 ensures that the insertion is made in only a certain direction.

As has been described above, the LED 50 is inserted into the socket 1, which in turn is mounted on the PCB socket 53, which in turn is mounted on the PCB to mount the LED 50 on the PCB 62. As a result, current flows from the contact portion of the PCB 62 to the PCB socket 53 to the contact terminal 6, the resistor 7, the lead terminal 4, the LED 50, the lead terminal 5, the PCB socket 53, and to the contact portion of the PCB 62 to turn on the LED 50.

As has been described above, with the LED socket according to the invention, it is possible to incorporate the resistor for limiting the current of an LED, thereby eliminating the soldering operation of the LED and the resistor on a printed circuit board and facilitating the indicator manufacture.

I claim:

1. A detachable socket for a two-lead electrical device having a pair of leads, comprising:

an insulating case consisting of a socket body with an insertion portion having a smaller circumference and a terminal opening on its side extending in its axial direction, and a cover portion attached to a top of said socket body and having a recess for receiving said two-lead electrical device;

a first lead terminal provided in said socket body and having a resistor contact and a first lead contact for contact with one of said leads;

a second lead terminal provided in said socket body and having a first contact portion extending downwardly along said insertion portion and exposed from said terminal opening on said insertion portion for contact with a first contact element of a mating socket;

a contact terminal mounted on an outside of said insertion portion and having a second contact portion extending downwardly along said insertion portion for contact with a second contact element of said mating socket and a second resistor contact extending laterally from a top portion thereof into said insertion portion; and a resistor provided within said socket body so that said resistor is held between said first and second resistor contacts.

* * * * *